US008774447B2

(12) United States Patent
Ko

(10) Patent No.: US 8,774,447 B2
(45) Date of Patent: Jul. 8, 2014

(54) CROSSOVER DOUBLE SPEAKER

(71) Applicant: Youngbo Engineering Industries, Inc., Asan-si (KR)

(72) Inventor: Ju-Heon Ko, Hwaseong-si (KR)

(73) Assignee: Youngbo Engineering Industries, Inc., Asan-Si (KR)

( * ) Notice: Subject to any disclaimer, the term of this patent is extended or adjusted under 35 U.S.C. 154(b) by 0 days.

(21) Appl. No.: 13/707,182

(22) Filed: Dec. 6, 2012

(65) Prior Publication Data

US 2013/0195293 A1 Aug. 1, 2013

(30) Foreign Application Priority Data

Jan. 27, 2012 (KR) ..... 10-2012-008174

(51) Int. Cl.
*H04R 9/06* (2006.01)

(52) U.S. Cl.
USPC ..... 381/396; 381/400; 381/412; 381/420; 381/150

(58) Field of Classification Search
USPC ..... 381/150, 342, 345, 190, 191, 396, 412
See application file for complete search history.

(56) References Cited

U.S. PATENT DOCUMENTS

| | | | | |
|---|---|---|---|---|
| 7,158,650 | B2 * | 1/2007 | Furuya et al. | 381/396 |
| 7,505,603 | B2 * | 3/2009 | Yoo | 381/404 |
| 8,189,847 | B2 * | 5/2012 | Huang | 381/380 |
| 2009/0279729 | A1 * | 11/2009 | Huang | 381/345 |

FOREIGN PATENT DOCUMENTS

| | | | |
|---|---|---|---|
| JP | 62-277000 | A | 12/1987 |
| JP | 11-252683 | A | 9/1999 |
| JP | 2003-111194 | A | 4/2003 |
| KR | 10-0662533 | B1 | 12/2006 |

* cited by examiner

*Primary Examiner* — Brian Ensey
*Assistant Examiner* — Sabrina Diaz
(74) *Attorney, Agent, or Firm* — Baker & Hostetler LLP

(57) ABSTRACT

Disclosed is a crossover double speaker having a small speaker and a large speaker on the upper side and on the lower side thereof. The crossover double speaker includes a cover integrally formed on the outer circumference of a flange of the yoke; a frame disposed below the cover; a first speaker unit including a first magnet disposed in a first speaker space, a first vibration plate arranged over the first magnet, and a first voice coil inserted into a first air gap; and a second speaker unit including a second magnet disposed in a second speaker space, a second vibration plate arranged between the yoke and the frame, and a second voice coil inserted into a second air gap. The yoke has sound release holes to output the sound generated from the second speaker unit in the direction of the first speaker unit.

1 Claim, 2 Drawing Sheets

CROSSOVER DOUBLE SPEAKER

RELATED APPLICATIONS

This application claims priority to Korean Patent Application No. 10-2012-008174, filed on Jan. 27, 2012 in the Korean Intellectual Property Office, the entire disclosure of which is incorporated herein by reference.

BACKGROUND OF THE INVENTION

1. Field of the Invention

The present invention relates to a crossover double speaker having a small speaker and a large speaker on the upper side and on the lower side thereof.

More specifically, the present invention relates to a crossover double speaker, which includes a frame with an upper portion open; a cover installed on the upper side of the frame; a yoke installed between the frame and the cover; a small speaker unit (hereinafter referred to as a "first speaker unit") which is installed on the bottom of the yoke, and has a first magnet with a first magnetic plate provided on the top face, and a small vibration plate (hereinafter referred to as a "first vibration plate") installed on the upper side of the flange of the yoke above the first magnet; and a large speaker unit (hereinafter referred to as a "second speaker unit") which is installed on the outside of the yoke, and has a second magnet with a second magnetic plate provided on the bottom face, and a large vibration plate (hereinafter referred to as a "second vibration plate") operated separately from the first vibration plate, and the sounds generated respectively from the first speaker unit and the second speaker unit are outputted in the same direction.

2. Description of the Related Art

Communication equipment such as a mobile phone like a smartphone and audio equipment such as an earphone have a speaker embedded therein, recently, a double speaker composed of two speakers has been provided to improve the quality of sound.

For example, conventional double speakers which have two speakers embedded therein are disclosed in Japanese Patent Laid-Open Publication No. S62-277000 (electroacoustic transducer), Japanese Patent Laid-Open Publication No. H11-252683 (electroacoustic transducer) Japanese Patent Laid-Open Publication No. 2003-111194 (loudspeaker and portable terminal device), Korean Patent Registration No. 10-662533 (speaker), and Korean Patent Laid-Open No. 10-2006-89937 (speaker).

Of these, the electroacoustic transducer disclosed in Japanese Patent Laid-Open Publication No. S62-277000 includes a first and second pole pieces installed at both ends of a magnet; a yoke which forms first and second magnetic gaps respectively between these pole pieces and the outer circumference thereof, and has a disk-type bottom, a cylinder portion formed integrally on the outer circumference of the bottom, and a flange extending outward from the top end of the cylinder portion; a first speaker unit which has a first vibration plate and a first voice coil of which one end is fixed to the first vibration plate and the other end portion is inserted into the first magnetic gap; and a second speaker unit which has a second vibration plate and a second voice coil of which one end is fixed to the second vibration plate and the other end portion is inserted into the second magnetic gap.

In order to form the first speaker unit having the first vibration plate on the lower side of the bottom of the yoke like above, a circular hole should be made on the bottom of the yoke to install the first voice coil, so the work is cumbersome.

Further, in order to form the second speaker unit having the second vibration plate on the upper side of the flange of the yoke, the first pole piece, the magnet, and the second pole piece should be laminated one after another, so the work is cumbersome. Furthermore, since the first pole piece, the magnet, and the second pole piece are laminated one after another in the cylinder portion of the yoke, the height of the cylinder portion increases. Therefore, the whole height of the electroacoustic transducer, namely, the speaker size increases and the whole volume thereof increases.

In particular, the low-pitched tone generated from the second speaker unit installed on the upper side of the flange of the yoke is dampened in the process of passing through between the cylinder portion with a high height and the inside of the housing. Therefore, a phenomenon of sound (output) reduction occurs. Further, since the second vibration plate of the second speaker unit and the first vibration plate of the first speaker unit are operated by the magnet installed singly, the capacity of the magnet should be increased. Therefore, the height of the electroacoustic transducer, namely, the speaker size increases and volume thereof increases. On the other hand, if the size (thickness) of the magnet is made smaller (thinner) in order to reduce the height and volume of the speaker, output of the audio equipment is lowered.

The electroacoustic transducer disclosed in Japanese Patent Laid-Open Publication No. H11-252683 includes a first speaker unit having a first vibration plate and a second speaker unit having a second vibration plate, a magnetic circuit having a magnet, a yoke, and a voice coil provided in a first magnetic gap, such that a vibration plate is driven by the operation of the magnetic circuit and the voice coil, wherein one magnetic circuit drives two vibration plates.

But since the first speaker unit, which has the first vibration plate on the lower side of the bottom of the yoke and on the outside of the cylinder portion, is formed, a phenomenon of the diameter of the first speaker unit increasing occurs. Therefore, the quality of sound is lowered as the deviation in speaker width with the second speaker unit decreases. Further, since there is no device installed in the cylinder portion of the yoke, space utilization in the cylinder portion is low.

Furthermore, in order to clearly distinguish the amplitude (sound) from the first speaker unit that has the diameter increased, the second speaker unit should be made larger. Therefore, the flange of the yoke widens, and the volume of the electroacoustic transducer increases. Since the second vibration plate of the second speaker unit and the first vibration plate of the first speaker unit are operated by the magnet installed singly on the outside (bottom face of the flange) of the cylinder portion, the output of audio equipment is lowered.

The loudspeaker disclosed in Japanese Patent Laid-Open Publication No. 2003-111194 and the speaker disclosed in Korean Patent Registration No. 10-662533 include a first speaker unit having a first magnet, a second speaker unit having a second magnet provided as to surround the first magnet, a yoke for linking the first magnet and the second magnet, a first voice coil, a first vibration plate connected to the first voice coil, a second vibration plate provided on the opposite side of the first magnet to the first vibration plate to be connected to the second voice coil, a first magnetic plate provided between the first vibration plate and the first magnet, and a second magnetic plate provided between the second vibration plate and the second magnet. The first voice coil is provided in a first magnetic gap between the first magnetic plate and the yoke, and the second voice coil is provided in a second magnetic gap between the second magnetic plate and the yoke.

But the first speaker unit installed on the upper side of the flange of the yoke like above and the second speaker unit installed on the lower side of the flange of the yoke have the sizes (diameters) of vibration plates equal, and there is a slight difference in the diameter of the voice coil installed in each vibration plate. Therefore, the amplitude of the tone (sound) generated from each vibration plate becomes almost the same, so it is not possible to clearly distinguish between high-pitched tones and low-pitched tones. Further, since the sounds generated from the respective speaker units installed on the upper side and lower side of the yoke are outputted in the respective directions (both sides), the size of the housing becomes larger.

The speaker disclosed in the Korean Patent Laid-Open Publication No. 10-2006-89937 includes a frame with the upper portion open, a yoke which is integrally joined to the lower side of the frame and inside which is formed a ring-type partition, a cap which is joined to the upper side of the frame and in which a flow hole is formed, an internal magnet installed on the inner side of the ring-type partition, an external magnet installed on the outside of the ring-type partition, a second ring-type external magnet, and a vibration plate which is installed on the upper side of the yoke and is formed integrally in the frame. The bottom face of the vibration plate is fixed to the ring-type partition by a vibration plate support, so the vibration plate is divided into an internal vibration plate and an external vibration plate. On the bottom faces of the internal vibration plate and the external vibration plate are installed respectively an internal voice coil and an external voice coil.

But the above speaker is divided by the vibration plate support, and the sounds (vibrations) generated from the integrally formed internal vibration plate and the external vibration plate are transmitted to each other to cause vibrational interference. Therefore, the sound outputted from the speaker unit is dampened, so the quality of sound is remarkably lowered. Since the sounds (vibrations) generated from the internal vibration plate and the external vibration plate are mixed and outputted in the same direction, the quality of sound decreases and the output of the audio equipment is lowered.

SUMMARY OF THE INVENTION

The present invention is to solve the above-mentioned problems with an object to provide a crossover double speaker, which includes a frame with the upper portion open; a cover installed on the upper side of the frame; a yoke installed between the frame and the cover; a first speaker unit which is installed on the bottom of the yoke, and has a first magnet with a first magnetic plate provided on the top face, and a first vibration plate installed on the upper side of the flange of the yoke above the first magnet; and a second speaker unit which is installed on the outside of the yoke, and has a second magnet with a second magnetic plate provided on the bottom face, and a second vibration plate operated separately from the first vibration plate, and the sounds generated respectively from the first speaker unit and the second speaker unit are outputted in the same direction.

Another object of the present invention is to provide a crossover double speaker, wherein the first speaker unit in which the first vibration plate is installed and the second speaker unit in which the second vibration plate is installed are divided into up and down by the yoke, so the first speaker unit generates high-pitched tones relatively higher than the tones generated from the second speaker unit, so that a wide frequency band can be secured and maintained and the size and thickness can be reduced to make it slim.

Yet another object of the present invention is to provide a crossover double speaker, wherein sound release holes are formed respectively on the upper outer circumference of the yoke and the inner circumference of the cover so that the sound generated from the second speaker unit can be released, so even if the respective sounds generated from the first speaker unit and the second speaker unit are outputted in the same direction, they are clearly distinguished before being outputted, and the phenomenon of one side sound being dampened conventionally to lower the quality of sound is prevented so as to improve the quality of sound.

In order to accomplish the foregoing objects, according to an aspect of the present invention, there is provided a crossover double speaker, which includes a yoke of a roughly U shape having a bottom, a cylinder portion integrally formed on the outer circumference of the bottom, and a flange extending outward from the top end of the cylinder portion; a first speaker unit having a first magnet arranged in a first speaker space provided by the bottom and the cylinder portion of the yoke; and a second speaker unit having a second magnet arranged in a second speaker space provided below the yoke, wherein a sound generated from the second speaker unit of the lower side is outputted in the direction of the first speaker unit, the crossover double speaker including: a cover which is integrally formed on the outer circumference of a flange of the yoke and extends downward from the flange of the yoke at a predetermined interval radially so as to surround the cylinder portion of the yoke that provides the first speaker space therein; and a frame which is disposed below the cover so as to provide the second speaker space, wherein the first speaker unit includes a first magnetic plate attached to the top face of the first magnet, a first vibration plate in which the outer circumference is fixed to the flange of the yoke by a first vibration plate holder, and a first voice coil of which one end is fixed to one face of the first vibration plate and the other end portion is inserted into a first air gap formed between the outer circumference of the first magnet and the cylinder portion, wherein the second speaker unit includes a second magnetic plate attached on the bottom face of the second magnet, a second vibration plate fixed between the second magnetic plate and the top end of the frame by a second vibration plate holder, and a second voice coil of which one end is fixed to one face of the second vibration plate and the other portion is inserted into a second air gap formed between the cylinder portion of the yoke and the second magnet, and wherein the yoke has sound release holes formed on the flange disposed between the cylinder portion and the second magnet to output the sound generated from the second speaker unit in the direction of the first speaker unit.

According to another aspect of the present invention, there is provided a crossover double speaker, which includes a yoke of a roughly U shape having a bottom, a cylinder portion integrally formed on the outer circumference of the bottom, and a flange extending outward from the top end of the cylinder portion; a first speaker unit having a first magnet disposed in a first speaker space provided by the bottom and the cylinder portion of the yoke; and a second speaker unit having a second magnet disposed in a second speaker space provided below the yoke, wherein a sound generated from the second speaker unit of the lower side is outputted in the direction of the first speaker unit, the crossover double speaker including: a cover which is integrally formed on the outer circumference of a flange of the yoke and extends downward from the flange of the yoke at a predetermined interval radially so as to surround the cylinder portion of the yoke that provides the first speaker space therein; a cap which is disposed opposite to the yoke for providing the first speaker space, and has a cap hole formed in the center thereof; and a frame which is disposed below the cover so as to provide the second speaker space, wherein the first speaker unit includes a first magnetic plate attached to the top face of the first magnet, a first vibration plate in which the outer circumference is fixed to the flange of the yoke by a first vibration plate holder, and a first voice coil of which one end is fixed to one face of the first vibration plate and the other end portion is inserted into a first air gap formed between the outer circumference of the first magnet and the cylinder portion, wherein the second speaker unit includes a second magnetic plate attached on the bottom face of the second magnet, a second vibration plate fixed between the second magnetic plate and the top end of the frame by a second vibration plate holder, and a second voice coil of which one end is fixed to one face of the second vibration plate and the other portion is inserted into a second air gap formed between the cylinder portion of the yoke and the second magnet, wherein the yoke has sound release holes formed on the flange disposed between the cylinder portion and the second magnet to output the sound generated from the second speaker unit in the direction of the first speaker unit, and wherein a frame hole formed in the center of the frame, a yoke hole formed on the bottom of the yoke, a magnet hole formed in the center of the first magnet, a through-hole arrayed in a straight line concentrically by a magnetic plate hole formed in the center of the first magnetic plate are provided, and the through-hole and the cap hole of the cap are arrayed in a straight line concentrically, so that the sound generated from the second speaker unit is released through the frame hole, and the sound generated from the first speaker unit is released through the cap hole, and the sound generated from the first speaker unit and the second speaker unit and mixed through the through-hole are released through sound release holes.

The crossover double speaker according to the present invention includes a frame with the upper portion open; a cover installed on the upper side of the frame; a yoke installed between the frame and the cover; a first speaker unit which is installed on the bottom of the yoke, and has a first magnet with a first magnetic plate provided on the top face, and a first vibration plate installed on the upper side of the flange of the yoke above the first magnet; and a second speaker unit which is installed on the outside of the yoke, and has a second magnet with a second magnetic plate provided on the bottom face, and a second vibration plate operated separately from the first vibration plate, and the sounds generated respectively from the first speaker unit and the second speaker unit are outputted in the same direction.

The present invention provides a crossover double speaker, wherein the first speaker unit in which the first vibration plate is installed and the second speaker unit in which the second vibration plate is installed are divided into up and down by the yoke, so the first speaker unit generates high-pitched tones relatively higher than the tones generated from the second speaker unit, so that a wide frequency band can be secured and maintained and the size and thickness can be reduced to make it slim.

Further, the present invention provides a crossover double speaker, wherein sound release holes are formed respectively on the upper outer circumference of the yoke and the inner circumference of the cover so that the sound generated from the second speaker unit can be released, so even if the respective sounds generated from the first speaker unit and the second speaker unit are outputted in the same direction, they are clearly distinguished before being outputted, and the phenomenon of one side sound being dampened conventionally to lower the quality of sound is prevented so as to improve the quality of sound.

Additionally, the speaker of the present invention is provided with a frame hole formed in the frame, a cap which is installed over the first vibration plate and has a cap hole, and a through-hole which passes through the first magnetic plate, the magnet and the first yoke, so that the sound generated from the first speaker unit and the sound generated from the second speaker unit are released in mutually opposite directions, and the mixed sound is released through a separate space. Therefore, the reproducibility of each sound is excellent, and the sound generated by the mixing of two sounds is also released through a separate release space, so both sounds are maintained to obtain an excellent quality of sound.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail below with reference to the accompanying drawings.

Figure 1:
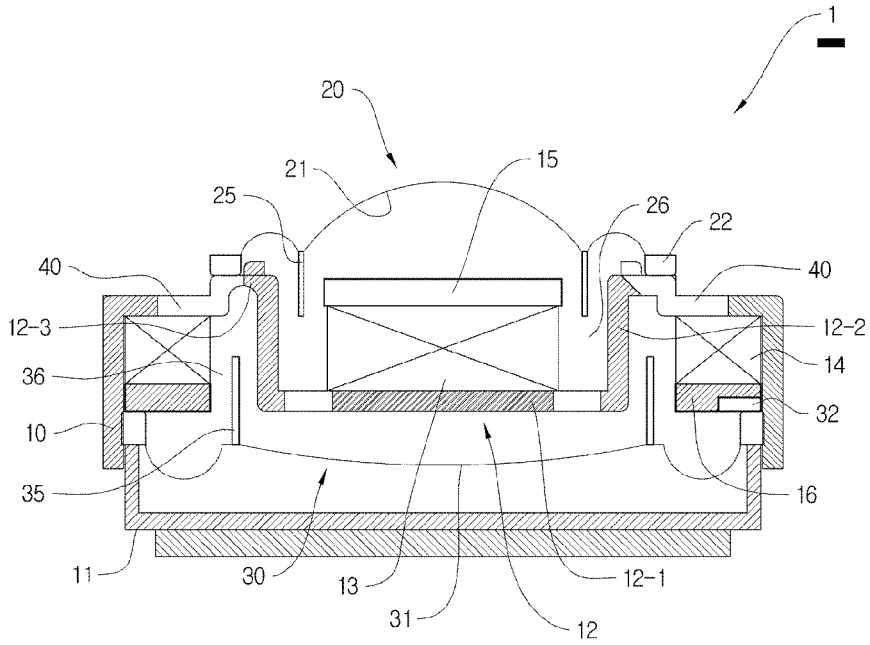
FIG. 1 is a sectional view showing the structure of a crossover double speaker according to a first embodiment of the present invention.
Figure 2:
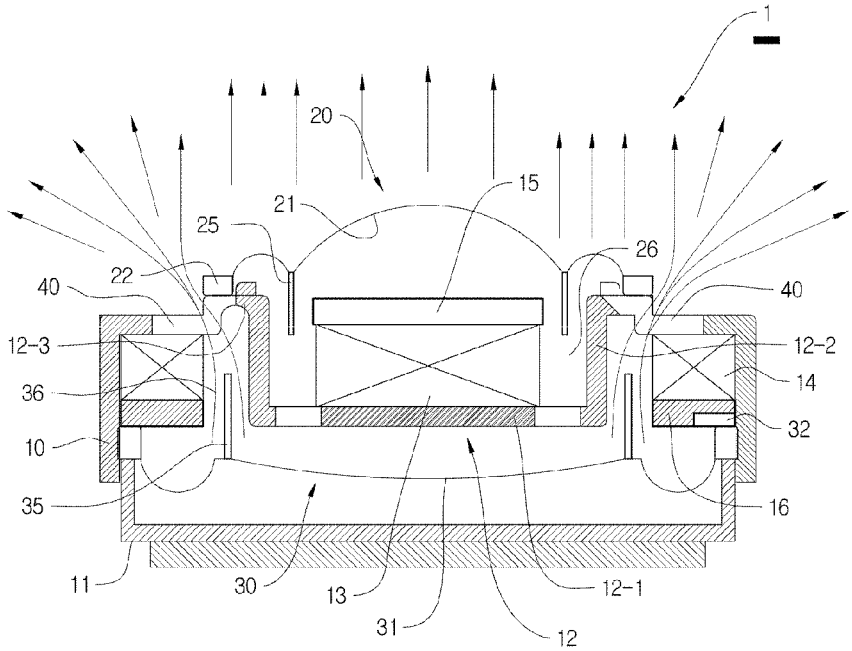
FIG. 2 is a sectional view showing the operation principle of the crossover double speaker according to the present invention.

FIG. 1 and FIG. 2 are views showing specific examples of a crossover double speaker 1 according to a first embodiment of the present invention. FIG. 1 is a sectional view showing the structure of the crossover double speaker 1 according to the present invention, and FIG. 2 is a sectional view showing the operation principle of the crossover double speaker 1 according to the present invention.

The structure of the crossover double speaker 1 according to the first embodiment of the present invention will be described.

The speaker 1 of the present embodiment includes a frame 11 with the upper portion open, a cover 10 joined to the upper side of the frame 11, a yoke 12 installed above the frame 11 inside of the cover 10, a first speaker unit 20 installed in a first speaker space provided on the upper side of the yoke 12, and a second speaker unit 30 installed in a second speaker space provided between the bottom 12-1 of the yoke 12 and the frame 11.

The yoke 12 includes a cylindrical bottom 12-1, a cylinder portion 12-2 formed integrally on the outer circumference of the bottom 12-1, and a flange 12-3 extending outward from the top end of the cylinder portion 12-2. The flange 12-3 of the yoke 12 protrudes slightly upward from the top face of the cover 10.

On the flange 12-3 of the yoke 12 and the top face of the cover 10 joined like above are formed sound release holes 40. Therefore, the sound (voice) generated from the second speaker unit 30 to be specifically described below is released (outputted) out of the first speaker unit 20 to be described later through the sound release holes 40.

The first speaker unit 20 installed on the upper side of the yoke 12 includes a first magnet 13 which is installed on the bottom 12-1 of the yoke 12 and is provided with a first magnetic plate 15 on the top face, a first vibration plate 21 installed above the first magnet 13, and a first voice coil 25 installed in a first air gap 26 formed between the outer circumference of the first magnet 13 and the cylinder portion 12-2 of the yoke 12.

In more detail, the first speaker unit 20 arranged in the first speaker space has the following configuration.

The first vibration plate 21 installed above the first magnet 13 has a small diameter. At this time, the outer circumference of the first vibration plate 21 is fixed to the flange 12-3 of the yoke 12 by a first vibration plate holder 22. The top end of the first voice coil 25 is fixed to one face (bottom face) of the first vibration plate 21, and the other end portion is inserted into the first air gap 26 formed between the outer circumference of the first magnet 13 and the cylinder portion 12-2.

The second speaker unit 30 installed in the second speaker space includes a second magnet 14 provided with a second magnetic plate 16 on the bottom face. The second magnet 14 is installed between the outer wall of the cylinder portion 12-2 of the yoke 12 and the inner face of the cover 10 joined to the frame 11. A second air gap 36 is formed between the second magnet 14 and the cylinder portion 12-2 of the yoke 12.

In more detail, the second speaker unit 30 installed in the second speaker space has the following configuration.

The second vibration plate 31 with a large diameter compared to the first vibration plate 21 is installed in an overturned shape in the second speaker space. The outer circumference of the second vibration plate 31 is fixed by a second vibration holder 32 between the second magnetic plate 16 and the top end of the frame 11. One end of the second voice coil 35 is fixed to one face (top face) of the second vibration plate 31, and the other end portion is inserted into the second air gap 36.

Next the operational relation of the crossover double speaker 1 according to the first embodiment of the present invention with the above configuration will be described.

In the first speaker unit 20, when an electrical signal is applied to the first voice coil 25 of the first vibration plate 21 inserted into the first air gap 26, driving force is generated in the first voice coil 25. By this driving force, the first vibration plate 21 connected to the first voice coil 25 vibrates to generate sound, and the sound generated in the first vibration plate 21 is outputted (released) to the upper central portion.

In the second speaker unit 30, when an electrical signal is applied to the second voice coil 35 of the second vibration plate 31 inserted into the second air gap 36, driving force is generated in the second voice coil 35. By this driving force, the second vibration plate 31 connected to the second voice coil 35 vibrates to generate sound, and the sound generated from the second vibration plate 31 is introduced into the second air gap 36 and is outputted (released) through the sound release holes 40.

Accordingly, as illustrated in FIG. 2 the sound outputted (released) from the second vibration plate 31 is outputted (released) to the outside of the sound outputted to the center from the first vibration plate 21, so they do not collide with each other.

In particular, the first speaker unit 20 has magnetic flux supplied from the first magnet 13 arranged on the bottom 12-1 of the yoke 12, that is, in the first air gap 26, and the second speaker unit 30 has magnetic flux supplied from the second magnet 14 arranged in the second air gap 36.

The first voice coil 25 of the first vibration plate 21 inserted into the first air gap 26 is driven easily by the first magnet 13, and the second voice coil 35 of the second vibration plate 31 inserted into the second air gap 36 is easily driven by the second magnet 14.

In the crossover double speaker 1 according to the present embodiment as described above, the sound generated from the first vibration plate 21 of the first speaker unit 20 is outputted (released) to the upper central portion, and the sound generated from the second vibration plate 31 of the second speaker unit 30 is outputted (released) to the outside of the sound from the first vibration plate 21 outputted to the center.

Accordingly, in the a crossover double speaker 1 according to the present embodiment, the sound generated from the first speaker unit 20 and the sound generated from the second speaker unit 30 do not collide with each other. Therefore, sounds are not offset or mixed, sound can be reproduced perfectly and the quality of sound can be improved.

Figure 3:
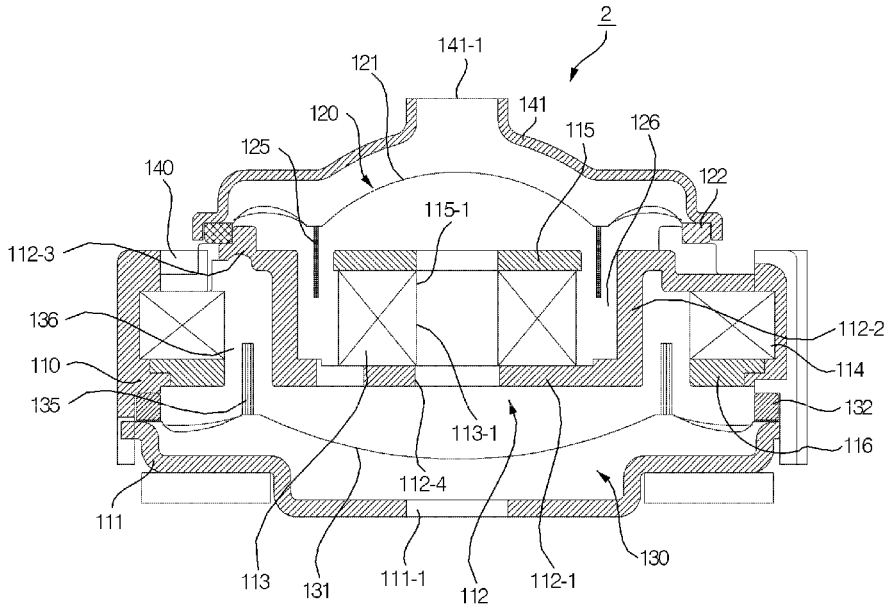
FIG. 3 is a sectional view showing the structure of a crossover double speaker according to a second embodiment of the present invention

Next, the structure of a crossover double speaker 2 according to a second embodiment of the present invention will be described with reference to FIG. 3.

The crossover double speaker 2 includes a frame 111 with the upper portion open, a cover 110 joined to the upper side of the frame 111, a yoke 112 joined to the upper portion of the cover 110 from the inner side thereof and upper side of the frame 111, a cap 141 disposed over the yoke 112, a first speaker unit 120 installed in a first speaker space provided between the yoke 112 and the cap 141, and the second speaker unit 130 installed in a second speaker space provided between the bottom 112-1 of the yoke 112 and the frame 111. A frame hole 111-1 is formed in the center of the frame 111.

The yoke 112 includes a cylindrical bottom 112-1 with a center yoke hole 112-4 formed therein, a cylinder portion 112-2 formed integrally on the outer circumference of the bottom 112-1, and a flange 112-3 extending outward from the top end of the cylinder portion 112-2. The flange 112-3 is made to protrude slightly upward from the top face of the cover 110.

On the top faces of the flange 112-3 and the cover 110 joined like above are formed sound release holes 140, so the sound (voice) generated from the second speaker unit 130 to be described below specifically is released (outputted) out of the second speaker unit 130 through sound release holes 140.

The first speaker unit 20 includes a first magnet 113 which is installed on the bottom 112-1 of the yoke 112 and is provided with a first magnetic plate 115 on the top face, a first vibration plate 121 installed above the first magnet 113, and a first voice coil 125 installed in a first air gap 126 formed between the outer circumference of the first magnet 113 and the cylinder portion 112-2 of the yoke 112. The first magnetic plate 115 has a magnetic plate hole 115-1 formed in the center, and the first magnet 113 has a first magnet hole 113-1 formed in the center concentrically with the magnet plate hole 115-1. As a result, the magnet plate hole 115-1 of the first magnetic plate 115, the first magnet hole 113-1 of the first magnet 113, and the yoke hole 112-4 of the yoke 112 form a through-hole that has a center corresponding as shown in FIG. 3.

In more detail, the second speaker unit 130 has the following configuration.

The first vibration plate 121 installed above the first magnet 113 has a small diameter. At this time, the outer circumference of the first vibration plate 121 is fixed to the flange 112-3 by a first vibration plate holder 122. One end of the first voice coil 125 is fixed to one face (bottom face) of the first vibration plate 121, the other end portion is inserted into the first air gap 126.

The outer circumference covering the first vibration plate 121 is fixed to the first vibration plate holder 122. Further, the outer circumference of the first vibration plate 121 is fixed to the flange 112-3 of the yoke 112 by the first vibration plate holder 122. The cap 141 is separated at a predetermined interval from the surface of the first vibration plate 121, so it provides the first speaker space and has a cap hole 141-1 formed in the center thereof. As a result, the through-hole made of the frame hole 111-1 of the frame 111, the yoke hole 112-4, the first magnet hole 113-1 and the magnetic hole 115-1 and the cap hole 141-1 of the cap 141 mentioned above become concentric and are arrayed in a straight line. At this time, it is preferable that the cross sectional area of the frame hole 111-1 and cap hole 141-1 is greater than that of the through-hole.

The second speaker unit 130 installed in the second speaker space includes a second magnet 114 installed between the outside of the cylinder portion 112-2 of the yoke 112 and the inner side of the cover joined to the frame 111, and a second voice coil 135 into which a second air gap 136 formed between the second magnet 114 and the cylinder portion 112-2 of the yoke 112 is inserted. The second magnet 114 is provided with a second magnetic plate 116 on the bottom face.

In more detail, the second speaker unit 130 installed in the second speaker space has the following configuration.

The second vibration plate 131 installed in an overturned shape in the second speaker space has a large diameter compared to the first vibration plate 121. The outer circumference of the second vibration plate 131 is fixed between a second magnetic plate 116 and the frame 111 by a second vibration plate holder 132. One end of the second voice coil 135 is fixed to one face (top face) of the second vibration plate 131, and the other end portion is inserted into the second air gap formed between the second magnet 114 and the cylinder portion 112-2.

Compared with the first embodiment, the differences of the crossover double speaker 2 according to the second embodiment of the present invention having the above-described configuration are that it has a cap 141 additionally and that it has a frame hole 111-1, a cap hole 141-1 and a through-hole, which are arrayed in a straight line.

Next, the operational relation of the crossover double speaker 2 according to the second embodiment of the present invention with the above configuration will be described.

In the second speaker unit 130, when an electrical signal is applied to the first voice coil 125 of the first vibration plate 121 inserted into the first air gap 126, driving force is generated in the first voice coil 125. By this driving force, the first vibration plate 121 connected to the first voice coil 125 vibrates to generate sound, and the sound generated from the first vibration plate 121 is outputted (released) to the upper central portion through the cap 141.

In the second speaker unit 130, when an electrical signal is applied to the second voice coil 135 of the second vibration plate 131 inserted into the second air gap 136, driving force is generated from the second voice coil 135. By this driving force, the second vibration plate 131 connected to the second voice coil 135 vibrates to generate sound, and the sound generated from the second vibration plate 131 is outputted (released) to the lower central portion through the frame hole 111-1.

Simultaneously with this, the sound released from the first speaker unit 120 is mixed or offset with the sound released from the second speaker unit 130 through the through-hole. After that, it is introduced into the second air gap 136 and outputted (released) through the sound release holes 140.

Accordingly, the sound outputted (released) from the second vibration plate 131 is released downward of the frame 111, and the sound released from the first vibration plate 121 is released upward of the cap 141, and the mixed sound from the second vibration plate 131 and the first vibration plate 121 is outputted (released) to the outside of the sound released upward, so that they do not collide with each other.

In particular, the second speaker unit 130 has magnetic flux supplied from above the bottom 112-1, that is, from the first magnet 113 installed in the first air gap 126, and the second speaker unit 130 has magnetic flux supplied from the second magnet 114 installed in the second air gap 136.

The first voice coil 125 of the first vibration plate 121 inserted into the first air gap 126 is easily driven by the first magnet 113, and the second voice coil 135 of the second vibration plate 131 inserted into the second air gap 136 is easily driven by the second magnet 114.

As described above, in the crossover double speaker 2 according to the second embodiment of the present invention, the sound generated from the first vibration plate 121 of the first speaker unit 120 is outputted (released) to the upper central portion through the cap 141, and the sound generated from the second vibration plate 131 of the second speaker unit 130 is released to the lower central portion. Simultaneously with this, the mixed sound from the second vibration plate 131 and the first vibration plate 121 is outputted (released) to the outside of the sound outputted to the center from the first vibration plate 121.

Accordingly in the crossover double speaker 2 of the present embodiment, the sound generated from the first speaker unit 120 and the sound generated from the second speaker unit 130 are released in mutually opposite directions, and the mixed sound is released through a separate space. Therefore, the reproducibility of each sound is excellent. Not only that, since the sound generated by the mixing of two sounds is also released through a separate release space, it is possible to improve the quality of sound with the sounds of both sides maintained.

While the present invention has been described with reference to the preferred embodiments, it will be understood by those skilled in the related art that various modifications and variations may be made therein without departing from the scope of the present invention as defined by the appended claims.

What is claimed is:

1. A crossover double speaker, which includes a yoke of a roughly U shape having a bottom, a cylinder portion integrally formed on the outer circumference of the bottom, and a flange extending outward from the top end of the cylinder portion; a first speaker unit having a first magnet disposed in a first speaker space provided by the bottom and the cylinder portion of the yoke; and a second speaker unit having a second magnet disposed in a second speaker space provided below the yoke, wherein a sound generated from the second speaker unit is outputted in the direction of the first speaker unit, the crossover double speaker further comprising:

a cover which is integrally formed on the outer circumference of the flange of the yoke and extends downward from the flange of the yoke at a predetermined interval radially so as to surround the cylinder portion of the yoke that provides the first speaker space therein;

a cap which is disposed opposite to the yoke for providing the first speaker space, and has a cap hole formed in the center thereof; and a frame which is disposed below the cover so as to provide the second speaker space, wherein the first speaker unit comprises a first magnetic plate attached to the top face of the first magnet, a first vibration plate in which the outer circumference is fixed to the flange of the yoke by a first vibration plate holder, and a first voice coil of which one end is fixed to one face of the first vibration plate and the other end portion is inserted into a first air gap formed between the outer circumference of the first magnet and the cylinder portion, wherein the second speaker unit comprises a second magnetic plate attached on the bottom face of the second magnet, a second vibration plate fixed between the second magnetic plate and the top end of the frame by a second vibration plate holder, and a second voice coil of which one end is fixed to one face of the second vibration plate and the other portion is inserted into a second air gap formed between the cylinder portion of the yoke and the second magnet, wherein the yoke has sound release holes formed on the flange disposed between the cylinder portion and the second magnet to output the sound generated from the second speaker unit in the direction of the first speaker unit, and wherein a frame hole formed in the center of the frame, a yoke hole formed on the bottom of the yoke, a magnet hole formed in the center of the first magnet, a through-hole arrayed in a straight line concentrically by a magnetic plate hole formed in the center of the first magnetic plate are provided, and the through-hole and the cap hole of the cap are arrayed in a straight line concentrically, so that the sound generated from the second speaker unit is released through the frame hole, and the sound generated from the first speaker unit is released through the cap hole, and the sound generated from the first speaker unit and the second speaker unit and mixed through the through-hole are released through sound release holes.

* * * * *